US011170690B2

(12) United States Patent
Fores Herranz et al.

(10) Patent No.: US 11,170,690 B2
(45) Date of Patent: Nov. 9, 2021

(54) PIXEL LEAKAGE AND INTERNAL RESISTANCE COMPENSATION SYSTEMS AND METHODS

(71) Applicant: Apple Inc., Cupertino, CA (US)

(72) Inventors: Adria Fores Herranz, Torello (ES); Chaohao Wang, Sunnyvale, CA (US); Jun Li, San Jose, CA (US); Koorosh Aflatooni, Los Altos Hills, CA (US); Pierre-Yves Emelie, Mountain View, CA (US); Sheng Zhang, San Jose, CA (US); Yingying Tang, Sunnyvale, CA (US); Yunhui Hou, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/003,730

(22) Filed: Aug. 26, 2020

(65) Prior Publication Data

US 2021/0097958 A1 Apr. 1, 2021

Related U.S. Application Data

(60) Provisional application No. 62/906,615, filed on Sep. 26, 2019, provisional application No. 62/906,619, filed on Sep. 26, 2019.

(51) Int. Cl.
*G09G 3/20* (2006.01)
*G09G 5/10* (2006.01)

(52) U.S. Cl.
CPC ..... *G09G 3/2003* (2013.01); *G09G 5/10* (2013.01); *G09G 2300/0452* (2013.01); *G09G 2320/0209* (2013.01); *G09G 2320/0214* (2013.01); *G09G 2320/0233* (2013.01); *G09G 2320/0242* (2013.01); *G09G 2320/0606* (2013.01);
(Continued)

(58) Field of Classification Search
CPC ..... G09G 3/2003; G09G 5/10; G09G 2300/0452; G09G 2320/209; G09G 2320/0214; G09G 2320/0233; G09G 2320/0242; G09G 2320/0606; G09G 2320/0626; G09G 2320/08; G09G 2340/06
See application file for complete search history.

(56) References Cited

U.S. PATENT DOCUMENTS 5,170,443 A 12/1992 Todd
7,119,772 B2 10/2006 Amundson et al.
(Continued)

*Primary Examiner* — Antonio Xavier
(74) *Attorney, Agent, or Firm* — Fletcher Yoder P.C.

(57) ABSTRACT

An electronic device may include an electronic display having multiple pixels to display an image based on processed image data. Each of the pixels may include multiple sub-pixels. The electronic device may also include image processing circuitry to receive input image data, in a first color space, having luminance values for each of the sub-pixels. The circuitry may also map the input image data from the first color space to a second color space and apply a multi-dimensional lookup table, based on the input image data in the second color space, to generate compensated image data. The lookup table may receive the luminance values for each of the sub-pixels and output corrected luminance values compensated for an expected amount of current leakage between the sub-pixels. The circuitry may also inversely map the compensated image data from the second color space to the first color space to generate the processed image data.

21 Claims, 11 Drawing Sheets

(52) U.S. Cl.
CPC . *G09G 2320/0626* (2013.01); *G09G 2320/08* (2013.01); *G09G 2340/06* (2013.01)

(56) References Cited

U.S. PATENT DOCUMENTS

| | | | | |
|---|---|---|---|---|
| 8,259,198 | B2 | 9/2012 | Cote et al. | |
| 8,520,023 | B2 | 8/2013 | Sullivan et al. | |
| 8,698,834 | B2 | 4/2014 | Brown Elliott | |
| 9,824,637 | B2 | 11/2017 | de Greef | |
| 2004/0212739 | A1* | 10/2004 | Kiuchi | H04N 5/20 348/674 |
| 2005/0285822 | A1 | 12/2005 | Reddy et al. | |
| 2008/0043260 | A1* | 2/2008 | Ramanath | G09G 5/06 358/1.9 |
| 2008/0068396 | A1 | 3/2008 | Ishii | |
| 2010/0277400 | A1 | 11/2010 | Jeong | |
| 2012/0201456 | A1* | 8/2012 | El-Mahdy | H04N 5/20 382/167 |
| 2014/0348232 | A1* | 11/2014 | Leontaris | H04N 19/186 375/240.12 |
| 2016/0353123 | A1* | 12/2016 | Ninan | H04N 5/2355 |
| 2018/0007374 | A1* | 1/2018 | Atkins | H04N 19/132 |
| 2018/0075798 | A1 | 3/2018 | Nho et al. | |
| 2019/0088199 | A1 | 3/2019 | Zhang et al. | |
| 2019/0158894 | A1* | 5/2019 | Lee | H04N 19/70 |
| 2020/0296398 | A1* | 9/2020 | Zhao | H04N 19/96 |

* cited by examiner

PIXEL LEAKAGE AND INTERNAL RESISTANCE COMPENSATION SYSTEMS AND METHODS

CROSS-REFERENCE TO RELATED APPLICATIONS

This application claims priority to and the benefit of U.S. Provisional Patent Application No. 62/906,615, filed Sep. 26, 2019, entitled "Pixel Leakage and Internal Resistance Compensation Systems and Methods," and U.S. Provisional Patent Application No. 62/906,619, filed Sep. 26, 2019, entitled "Pixel Leakage and Internal Resistance Compensation Systems and Methods," both of which are incorporated herein by reference in their entireties for all purposes. This application is related to U.S. application Ser. No. 17/003,757, filed Aug. 26, 2020, entitled "Pixel Leakage and Internal Resistance Compensation Systems and Methods," which is incorporated herein by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Numerous electronic devices—including televisions, portable phones, computers, wearable devices, vehicle dashboards, virtual-reality glasses, and more—display images on an electronic display. As electronic displays gain increasingly higher resolutions and dynamic ranges, they may also become increasingly more susceptible to image display artifacts due to current leakage between pixels and/or a voltage drop across pixel circuitry associated with an internal resistance (IR) of the pixel circuitry. Furthermore, although a pixel may be commonly considered singularly, each pixel may include a grouping of sub-pixels separate from each other and potentially "cross talking" with each other and with other surrounding sub-pixels. For example, intra-pixel current leakage may occur between sub-pixels of the same pixel, and inter pixel current leakage may occur between sub-pixels of surrounding sub-pixels that may be associated with other pixels. The lateral leakage of current between sub-pixels and/or IR drop within a sub-pixel's circuitry may alter the luminance output of the sub-pixels and induce perceivable artifacts such as banding, color inaccuracies, edge effects, etc. As such, image processing circuitry, such as implemented in a display pipeline, may be used to compensate for current leakage and/or IR drop.

In one embodiment, one or more 3-dimensional (3D) lookup tables (LUTs) may be used to compensate for intra-pixel current leakage and/or IR drop. For example, the 3D LUT may take as an input the luminance values for each of the sub-pixels (e.g., a red sub-pixel, a blue sub-pixel, and/or a green sub-pixel) of the pixel and output a compensated luminance value for each sub-pixel. As should be appreciated, although discussed herein as using a 3D LUT, any suitable LUT or computational algorithm may be used to calculate the compensated values, depending on implementation. However, in some scenarios, LUTs may prove less taxing on system resources (e.g., processor bandwidth, communicational bandwidth, and/or memory bandwidth). The compensated values may take into account the values of each sub-pixel, relative to the other sub-pixels, and boost the luminance of sub-pixels that would have otherwise decreased in luminance output and/or attenuate the luminance of sub-pixels that would have otherwise increased in luminance output.

Additionally or alternatively, a LUT may be used to compensate for IR drop by boosting the luminance of a sub-pixel based on the luminance level of the sub-pixel and/or the luminance of the surrounding sub-pixels. For example, a sub-pixel with a higher target luminance may receive a larger boost to compensate for a larger IR drop because the higher amount of current associated with the higher target luminance may induce a larger IR drop. Additionally or alternatively, the compensation for the IR drop and the intra-pixel current leakage may be combined into a single 3D LUT.

The LUT(s) for IR drop and current leakage may have equal or approximately equal tap points such that interpolation (e.g., linear or non-linear) may be accomplished to specify compensation values between those of the LUT. However, in some scenarios, the rate of change of the current leakage at lower brightness may change more quickly than at high brightness. In other words, the concavity of the current leakage as a function of luminance value may lead to greater errors in interpolation at lower brightness than at higher brightness. To help reduce such potential variations in the interpolation, the input image data may be mapped to a non-linear space (e.g., a gamma color space or other non-linear space) before the 3D LUT is applied to "squeeze" the tap points of the 3D LUT at lower brightness and spread out the tap points of the 3D LUT at higher brightness. Indeed, in the non-linear space, the 3D LUT may provide higher fidelity for interpolation of the compensation values at lower brightness settings than at higher brightness. Moreover, when the brightness of the display is less than a threshold value (e.g., 500 nits, 100 nits, 50 nits, 10 nits, etc.) the non-linear mapping may be engaged, the 3D LUT applied, and an inverse mapping may be utilized to return the image data to the original color space. Further, because of the lack of variation in tap point spacing, the original, linear, color space may provide better resolution at higher brightness than tap points in the non-linear color space. Therefore, when the brightness of the display is greater than the threshold value, the non-linear mapping and corresponding inverse mapping may be disengaged/bypassed. As such, the same 3D LUT may be utilized in different color spaces depending on a brightness (e.g., a luminance output and/or a brightness setting) of the electronic display relative to a threshold to obtain better interpolation resolution between tap points in both low brightness and high brightness.

Additionally or alternatively to the 3D LUT(s) for IR drop and/or intra-pixel current leakage, compensation for inter-pixel current leakage may be applied. For example, a compensation value attributable to each sub-pixel surrounding a sub-pixel of interest, whether grouped as a single pixel with the sub-pixel of interest or grouped with a different pixel, may be calculated, summed, and applied to the luminance value of the sub-pixel of interest. In one embodiment, a two dimensional (2D) LUT may be referenced for each type (e.g., color) of sub-pixel acting on another type of sub-pixel. For example, compensation of a green sub-pixel may reference a LUT associated with another green sub-pixel acting on the green sub-pixel, a LUT associated with a red sub-pixel acting on the green sub-pixel, and a LUT associated with a blue sub-pixel acting on the green sub-pixel. The luminance levels of each of the corresponding surrounding sub-pixel may be used in the corresponding 2D LUT with the luminance level of the sub-pixel of interest to generate a luminance compensation value. The compensation values may be applied to the luminance value of the sub-pixel of interest, and the likelihood of perceivable artifacts may be reduced.

BRIEF DESCRIPTION OF THE DRAWINGS

Various aspects of this disclosure may be better understood upon reading the following detailed description and upon reference to the drawings in which.

DETAILED DESCRIPTION

Figure 1:
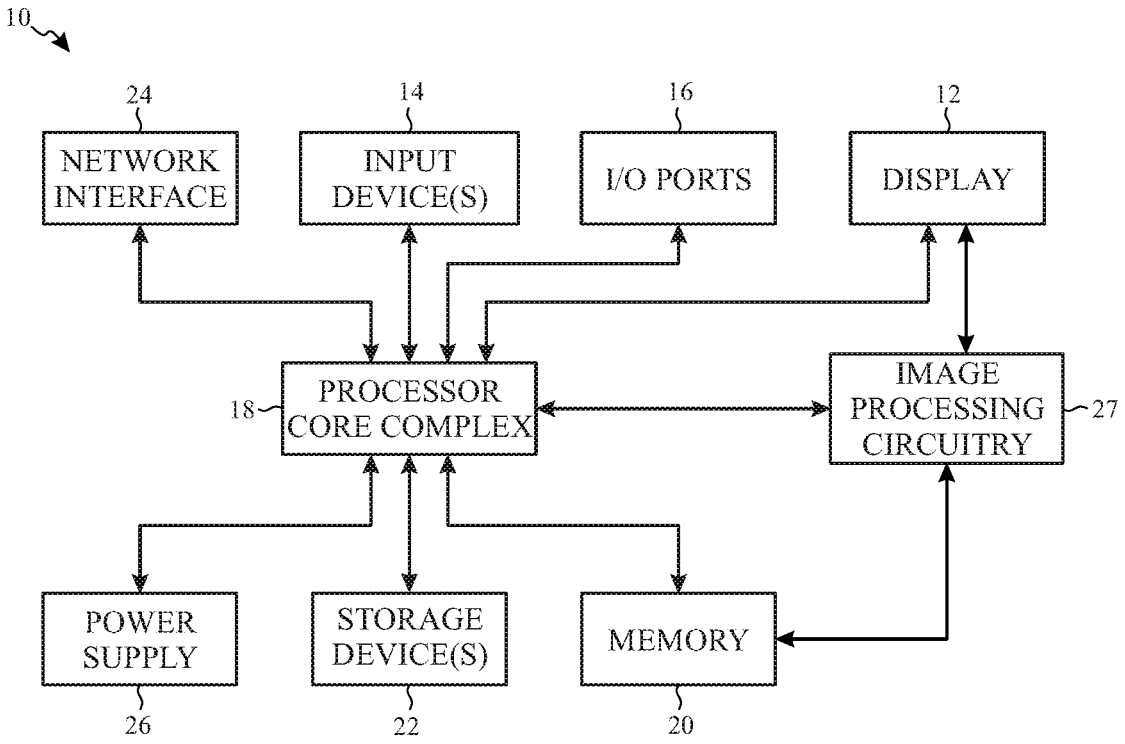
FIG. 1 is a block diagram of an electronic device including an electronic display, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Numerous electronic devices—including televisions, portable phones, computers, wearable devices, vehicle dashboards, virtual-reality glasses, and more—display images on an electronic display. As electronic displays gain increasingly higher resolutions and dynamic ranges, they may also become increasingly more susceptible to image display artifacts due to current leakage between pixels and/or a voltage drop across pixel circuitry associated internal resistance (IR) of the pixel circuitry. Furthermore, although a pixel may be commonly considered singularly, each pixel may include a grouping of sub-pixels separated from each other and potentially "cross talking" with each other and with other surrounding sub-pixels. For example, intra-pixel current leakage may occur between sub-pixels of the same pixel, and inter pixel current leakage may occur between sub-pixels of surrounding sub-pixels that may be associated with other pixels. The lateral leakage of current between sub-pixels and/or IR drop within a sub-pixel's circuitry may alter the luminance output of the sub-pixels and induce perceivable artifacts such as banding, color inaccuracies, edge effects, etc. As such, image processing circuitry, such as implemented in a display pipeline, may be used to compensate for current leakage and/or IR drop.

To help illustrate, one embodiment of an electronic device 10 that utilizes an electronic display 12 is shown in FIG. 1. As will be described in more detail below, the electronic device 10 may be any suitable electronic device, such as a handheld electronic device, a tablet electronic device, a notebook computer, and the like. Thus, it should be noted that FIG. 1 is merely one example of a particular implementation and is intended to illustrate the types of components that may be present in the electronic device 10.

In the depicted embodiment, the electronic device 10 includes the electronic display 12, input devices 14, input/output (I/O) ports 16, a processor core complex 18 having one or more processors or processor cores, local memory 20, a main memory storage device 22, a network interface 24, a power source 26, and image processing circuitry 27. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the local memory 20 and the main memory storage device 22 may be included in a single component. Additionally, the image processing circuitry 27 (e.g., a graphics processing unit, a display image processing pipeline) may be included in the processor core complex 18.

As depicted, the processor core complex 18 is operably coupled with local memory 20 and the main memory storage device 22. In some embodiments, the local memory 20 and/or the main memory storage device 22 may include tangible, non-transitory, computer-readable media that store instructions executable by the processor core complex 18 and/or data to be processed by the processor core complex 18. For example, the local memory 20 may include random access memory (RAM) and the main memory storage device 22 may include read only memory (ROM), rewritable non-volatile memory such as flash memory, hard drives, optical discs, and/or the like.

In some embodiments, the processor core complex 18 may execute instruction stored in local memory 20 and/or the main memory storage device 22 to perform operations, such as generating source image data. As such, the processor core complex 18 may include one or more general purpose microprocessors, one or more application specific processors (ASICs), one or more field programmable logic arrays (FPGAs), or any combination thereof.

As depicted, the processor core complex 18 is also operably coupled with the network interface 24. Using the network interface 24, the electronic device 10 may be communicatively coupled to a network and/or other electronic devices. For example, the network interface 24 may connect the electronic device 10 to a personal area network (PAN), such as a Bluetooth network, a local area network (LAN), such as an 802.11x Wi-Fi network, and/or a wide area network (WAN), such as a 4G or LTE cellular network. In this manner, the network interface 24 may enable the electronic device 10 to transmit image data to a network and/or receive image data from the network.

Additionally, as depicted, the processor core complex 18 is operably coupled to the power source 26. In some embodiments, the power source 26 may provide electrical power to operate the processor core complex 18 and/or other components in the electronic device 10. Thus, the power source 26 may include any suitable source of energy, such as a rechargeable lithium polymer (Li-poly) battery and/or an alternating current (AC) power converter.

Furthermore, as depicted, the processor core complex 18 is operably coupled with the I/O ports 16 and the input devices 14. In some embodiments, the I/O ports 16 may enable the electronic device 10 to interface with various other electronic devices. Additionally, in some embodiments, the input devices 14 may enable a user to interact with the electronic device 10. For example, the input devices 14 may include buttons, keyboards, mice, trackpads, and the like. Additionally or alternatively, the electronic display 12 may include touch sensing components that enable user inputs to the electronic device 10 by detecting occurrence and/or position of an object touching its screen (e.g., surface of the electronic display 12).

In addition to enabling user inputs, the electronic display 12 may facilitate providing visual representations of information by displaying one or more images (e.g., image frames or pictures). For example, the electronic display 12 may display a graphical user interface (GUI) of an operating system, an application interface, text, a still image, or video content. To facilitate displaying images, the electronic display 12 may include a display panel with one or more display pixels. Additionally, each display pixel may include one or more sub-pixels, which each control luminance of one color component (e.g., red, blue, or green). As should be appreciated, a pixel may include any suitable grouping of sub-pixels such as red, blue, green, and white (RBGW), or other color sub-pixel, and/or may include multiple of the same color sub-pixel. For example, a pixel may include one blue sub-pixel, one red sub-pixel, and two green sub-pixels (GRGB).

As described above, the electronic display 12 may display an image by controlling luminance of the sub-pixels based at least in part on corresponding image data (e.g., image pixel image data and/or display pixel image data). In some embodiments, the image data may be received from another electronic device, for example, via the network interface 24 and/or the I/O ports 16. Additionally or alternatively, the image data may be generated by the processor core complex 18 and/or the image processing circuitry 27.

Figure 2:
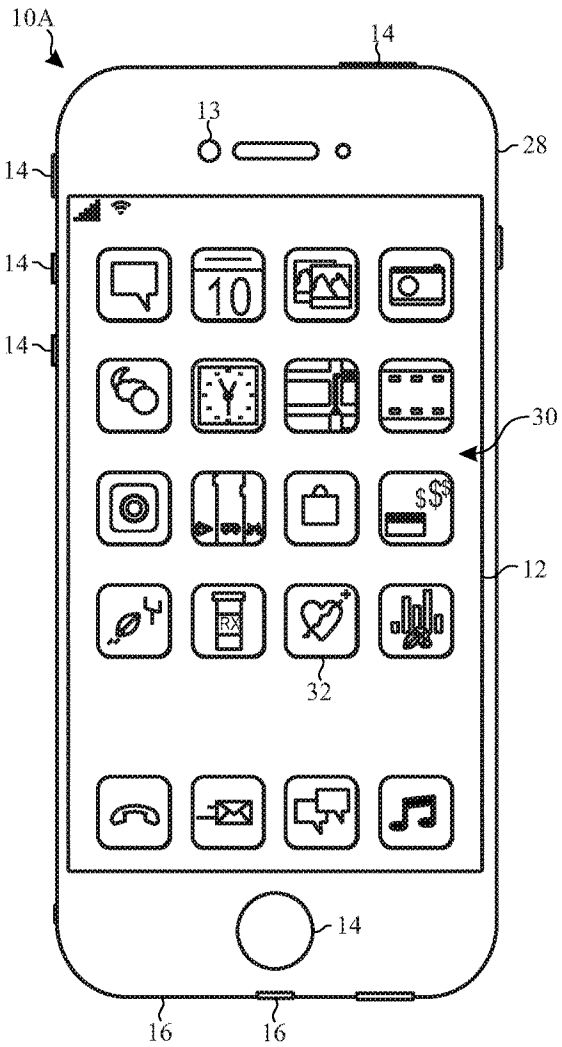
FIG. 2 is an example of the electronic device of FIG. 1, in accordance with an embodiment.

As described above, the electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For example, the handheld device 10A may be a smart phone, such as any iPhone® model available from Apple Inc.

As depicted, the handheld device 10A includes an enclosure 28 (e.g., housing). In some embodiments, the enclosure 28 may protect interior components from physical damage and/or shield them from electromagnetic interference. Additionally, as depicted, the enclosure 28 surrounds the electronic display 12. In the depicted embodiment, the electronic display 12 is displaying a graphical user interface (GUI) 30 having an array of icons 32. By way of example, when an icon 32 is selected either by an input device 14 or a touch-sensing component of the electronic display 12, an application program may launch.

Furthermore, as depicted, input devices 14 open through the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. As depicted, the I/O ports 16 also open through the enclosure 28. In some embodiments, the I/O ports 16 may include, for example, an audio jack to connect to external devices.

Figure 3:
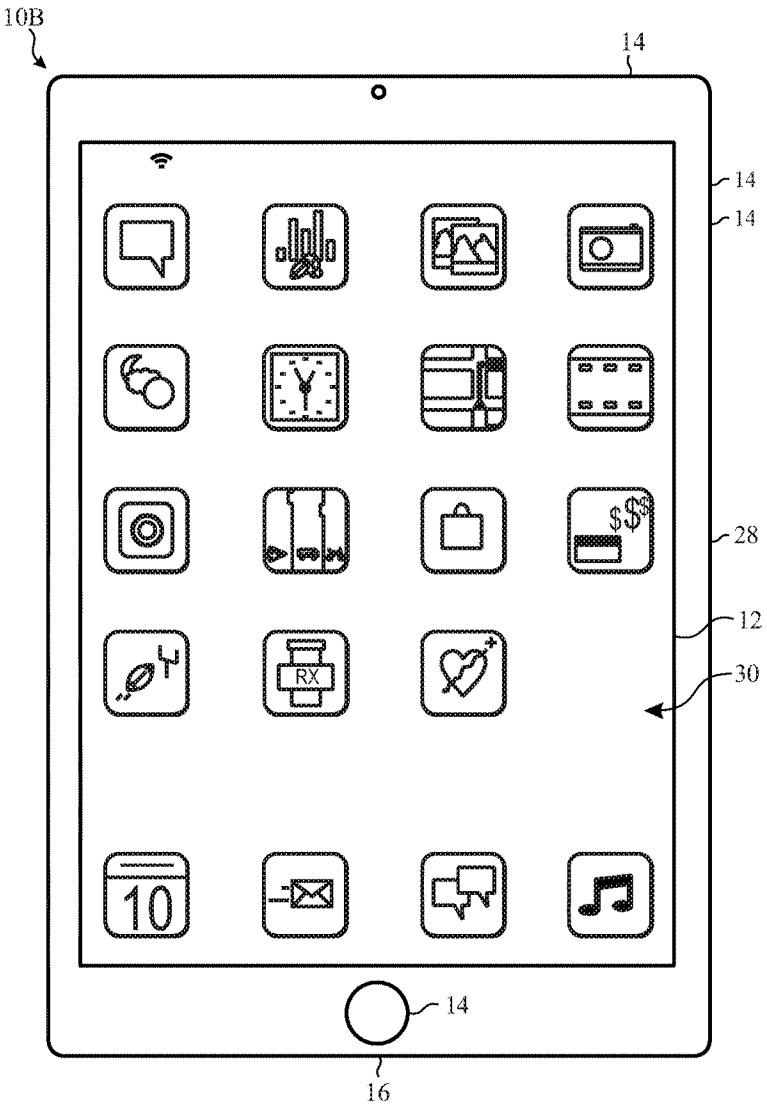
FIG. 3 is another example of the electronic device of FIG. 1, in accordance with an embodiment.
Figure 4:
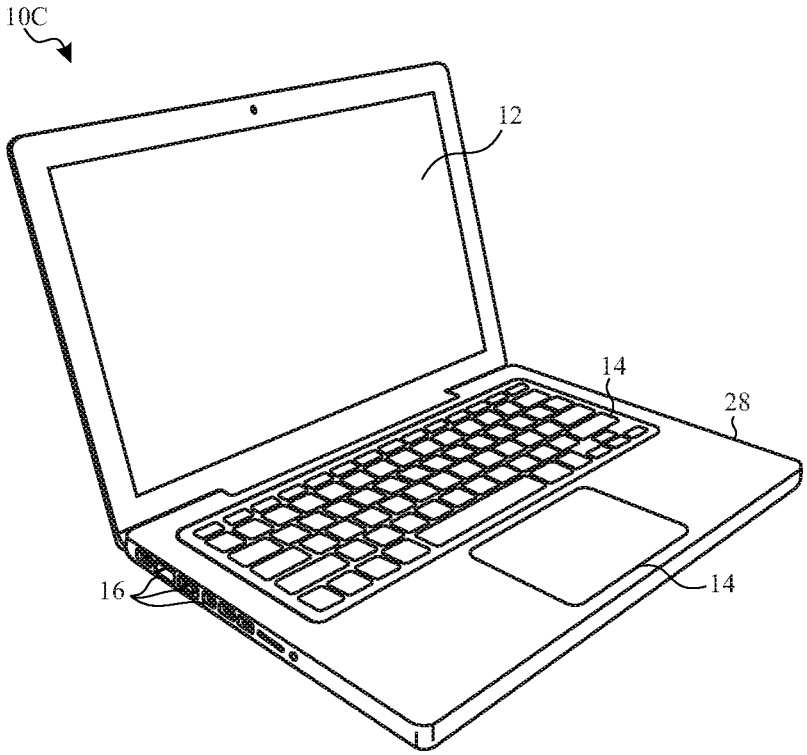
FIG. 4 is another example of the electronic device of FIG. 1, in accordance with an embodiment.
Figure 5:
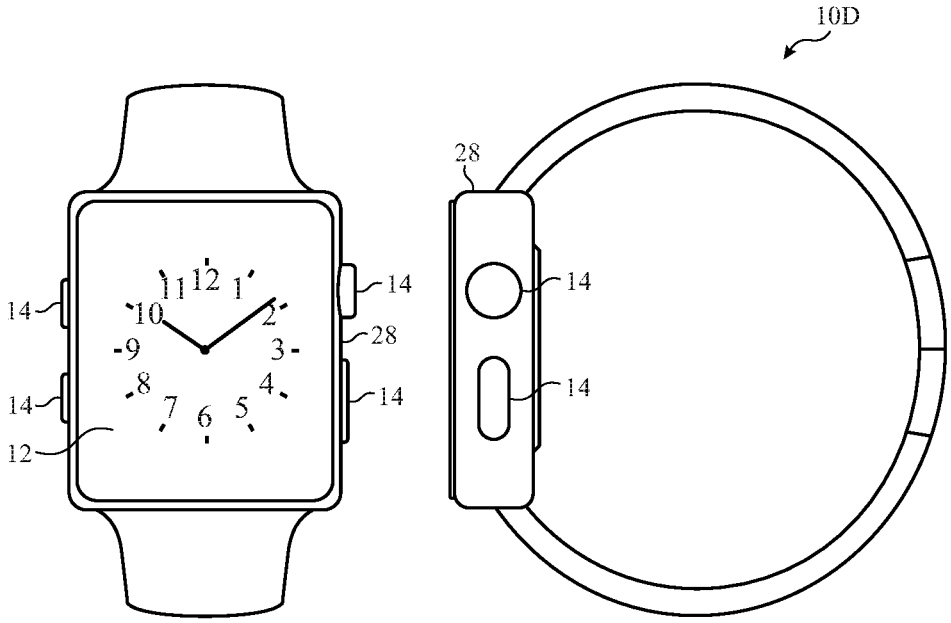
FIG. 5 is another example of the electronic device of FIG. 1, in accordance with an embodiment.

To further illustrate, another example of a suitable electronic device 10, specifically a tablet device 10B, is shown in FIG. 3. For illustrative purposes, the tablet device 10B may be any iPad® model available from Apple Inc. A further example of a suitable electronic device 10, specifically a computer 10C, is shown in FIG. 4. For illustrative purposes, the computer 10C may be any MacBook® or iMac® model available from Apple Inc. Another example of a suitable electronic device 10, specifically a watch 10D, is shown in FIG. 5. For illustrative purposes, the watch 10D may be any Apple Watch® model available from Apple Inc. As depicted, the tablet device 10B, the computer 10C, and the watch 10D each also includes an electronic display 12, input devices 14, I/O ports 16, and an enclosure 28.

As described above, the electronic display 12 may display images based at least in part on image data received, for example, from the processor core complex 18 and/or the image processing circuitry 27. Additionally, as described above, the image data may be processed before being used to display a corresponding image on the electronic display 12. In some embodiments, a display pipeline may process the image data, for example, to identify and/or compensate for burn-in and/or aging artifacts.

Figure 6:
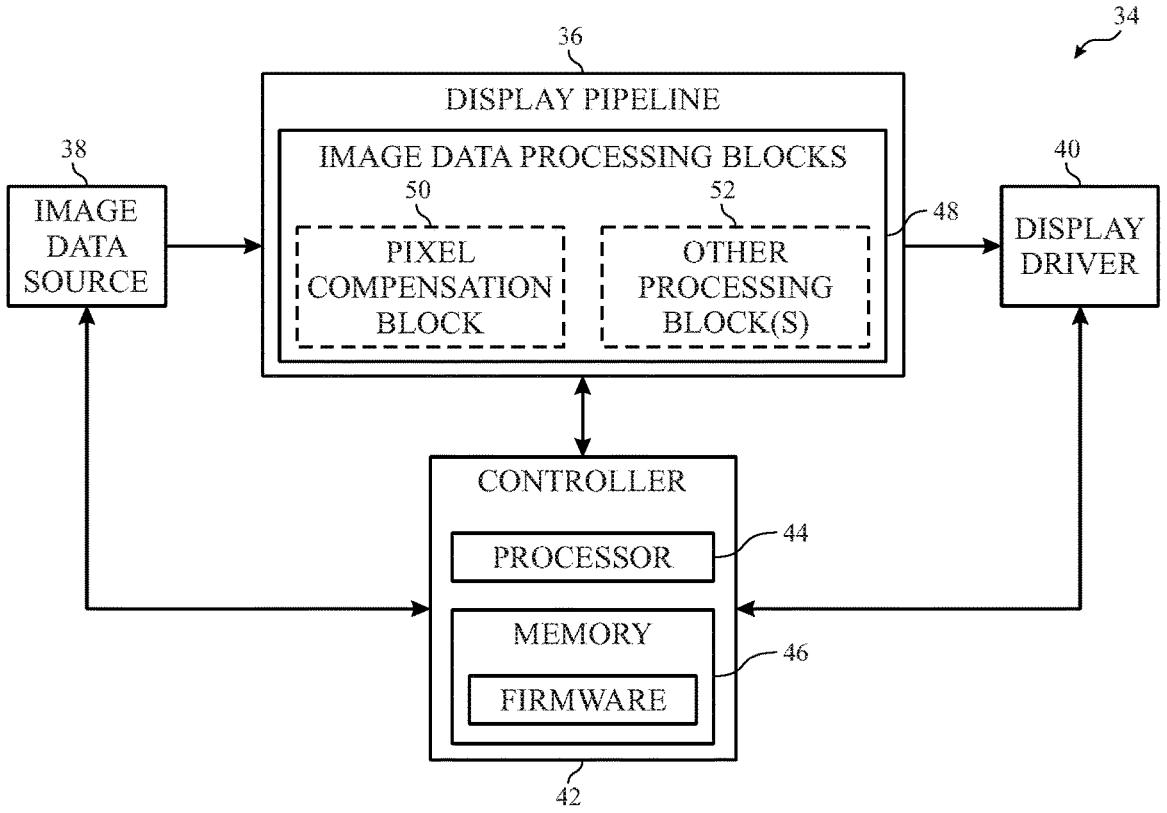
FIG. 6 is a block diagram of a portion of the electronic device of FIG. 1 including a display pipeline that has pixel compensation circuitry, in accordance with an embodiment.

To help illustrate, a portion 34 of the electronic device 10 including a display pipeline 36 is shown in FIG. 6. In some embodiments, the display pipeline 36 may be implemented by circuitry in the electronic device 10, circuitry in the electronic display 12, or a combination thereof. For example, the display pipeline 36 may be included in the processor core complex 18, the image processing circuitry 27, a timing controller (TCON) in the electronic display 12, or any combination thereof.

As depicted, the portion 34 of the electronic device 10 also includes an image data source 38, a display panel 40, and a controller 42. In some embodiments, the display panel 40 of the electronic display 12 may be a liquid crystal display (LCD), a light emitting diode (LED) display, an organic LED (OLED) display, or any other suitable type of display panel 40. In some embodiments, the controller 42 may control operation of the display pipeline 36, the image data source 38, and/or the display panel 40. To facilitate controlling operation, the controller 42 may include a controller processor 44 and/or controller memory 46. In some embodiments, the controller processor 44 may be included in the processor core complex 18, the image processing circuitry 27, a timing controller in the electronic display 12, a separate processing module, or any combination thereof and execute instructions stored in the controller memory 46. Additionally, in some embodiments, the controller memory 46 may be included in the local memory 20, the main memory storage device 22, a separate tangible, non-transitory, computer readable medium, or any combination thereof.

In the depicted embodiment, the display pipeline 36 is communicatively coupled to the image data source 38. In this manner, the display pipeline 36 may receive input image data corresponding with an image to be displayed on the electronic display 12 from the image data source 38. The source image data may indicate target characteristics (e.g., pixel data of target luminance values) corresponding to a desired image using any suitable source format, such as an 8-bit fixed point αRGB format, a 10-bit fixed point αRGB format, a signed 16-bit floating point αRGB format, an 8-bit fixed point YCbCr format, a 10-bit fixed point YCbCr format, a 12-bit fixed point YCbCr format, and/or the like. In some embodiments, the image data source 38 may be included in the processor core complex 18, the image processing circuitry 27, or a combination thereof. Furthermore, the input image data may reside in a linear color space, a gamma-corrected color space, or any other suitable color space. As used herein, pixels and pixel data may refer to a grouping of sub-pixels (e.g., individual color component pixels such as red, green, and blue) and the pixel data therefore, respectively.

As described above, the display pipeline 36 may operate to process image data received from the image data source 38. The display pipeline 36 may include one or more image data processing blocks 48 (e.g., circuitry, modules, or processing stages) such as the pixel compensation block 50 and/or one or more other processing blocks 52. As should be appreciated, multiple image data processing blocks may be incorporated into the display pipeline 36, such as a color management block, a dither block, a burn-in compensation block, etc. Further, the functions (e.g., operations) performed by the display pipeline 36 may be divided or shared between various image data processing blocks and/or sub-blocks, and while the term "block" is used herein, there may or may not be a physical or logical separation between the image data processing blocks 48 and/or sub-blocks thereof.

After processing, the display pipeline 36 may output the image data to the display panel 40, and based on the processed image data, the display panel 40 may apply analog electrical signals to the sub-pixels of the electronic display 12 to cumulatively display one or more corresponding images. In this manner, the display pipeline 36 may facilitate providing visual representations of information on the electronic display 12. As should be appreciated, the display pipeline 36 may be implemented in whole or in part by executing instructions stored in a tangible non-transitory computer-readable medium, such as the controller memory 46, using processing circuitry, such as the controller processor 44.

As stated above, other processing blocks 52 may also be utilized in the display pipeline 36. As such, the input image data and/or the compensated image data may be processed by the other processing blocks 52 before and/or after the pixel compensation block 50. The pixel compensation block 50 may compensate for current leakage between sub-pixels and/or a voltage drop associated with internal resistance (IR) of the sub-pixel circuitry. As such, the resulting image data output by the display pipeline 36 for display on the display panel 40 may suffer substantially fewer perceivable artifacts.

Figure 7:
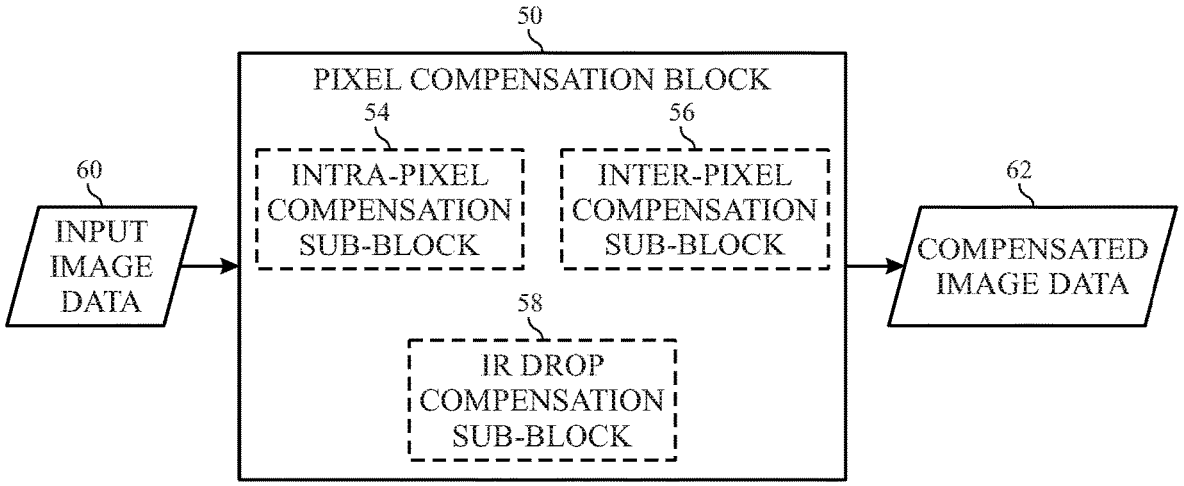
FIG. 7 is a block diagram of a portion of the display pipeline of FIG. 6 including the pixel compensation block, in accordance with an embodiment.

As stated above, each pixel may include a grouping of sub-pixels separate from each other and potentially "cross talking" with each other and with other surrounding sub-pixels. For example, intra-pixel current leakage may occur between sub-pixels of the same pixel, and inter pixel current leakage may occur between sub-pixels of surrounding sub-pixels that may be associated with other pixels. Additionally, IR drop within a sub-pixel's circuitry may alter (e.g., reduce) the luminance output of the sub-pixel. The pixel compensation block 50 may include an intra-pixel compensation sub-block 54, an inter-pixel compensation sub-block 56, and an IR drop compensation sub-block 58, as shown in the block diagram of FIG. 7, to assist in reducing the likelihood of perceivable artifacts such as banding, color inaccuracies, edge effects, etc. that may be caused by the IR drop and/or current leakage. In general, the pixel compensation block 50 may receive pixel data representative of each of the color components of the input image data 60, generate compensated image data 62 via the intra-pixel compensation sub-block 54, the inter-pixel compensation sub-block 56, and/or the IR drop compensation sub-block 58, and output the compensated image data 62 to the other processing blocks 52 and/or the display panel 40.

Figure 8:
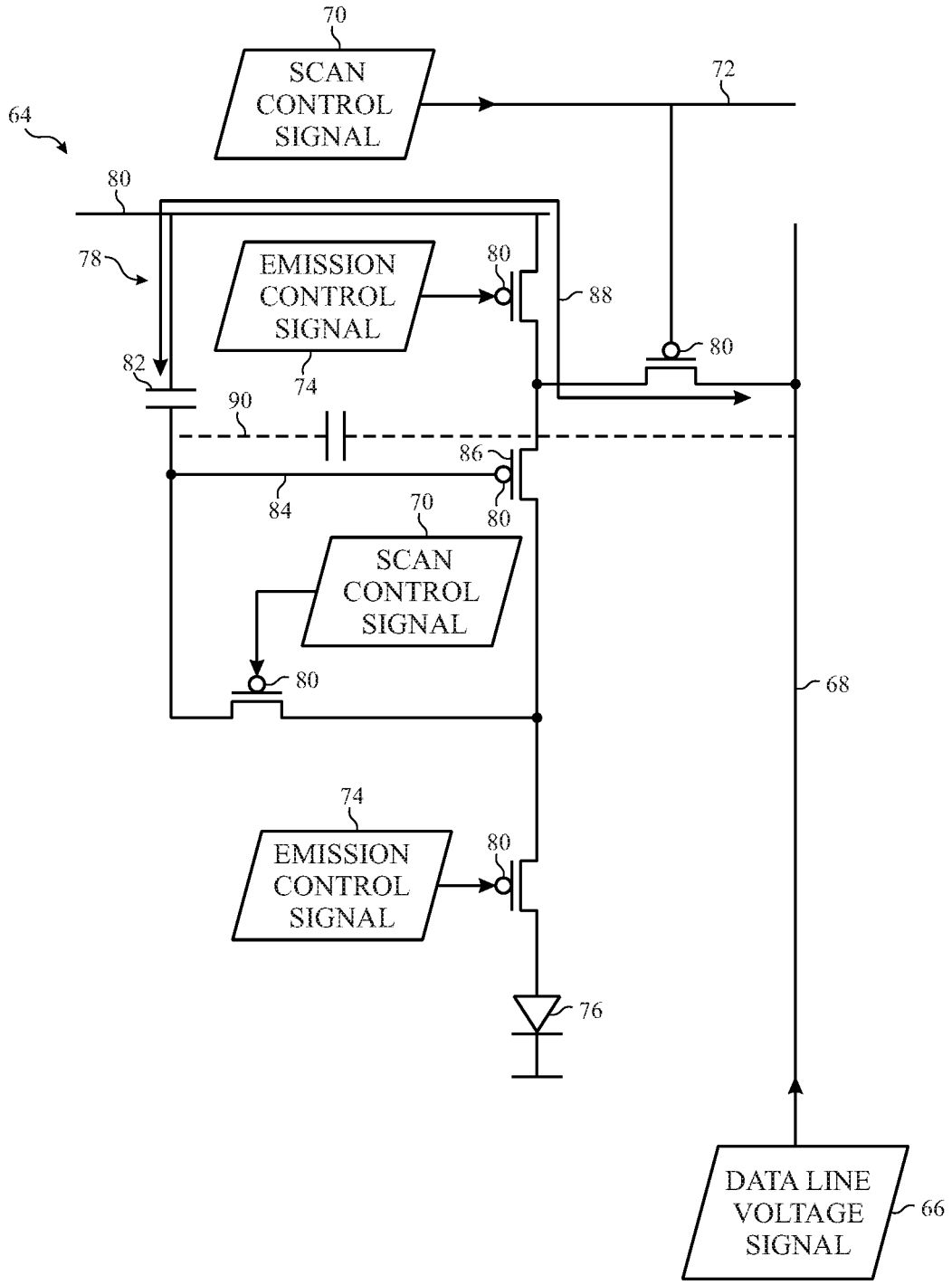
FIG. 8 is a schematic diagram of a sub-pixel and example circuitry, in accordance with an embodiment.

To help illustrate the effects on a sub-pixel 64 that are rectified by the pixel compensation block 50, FIG. 8 is a simplified schematic diagram of a sub-pixel 64. The sub-pixel 64 may be controlled by a data line voltage signal 66 (e.g., on data line 68), a scan control signal 70 (e.g., on scan line 72), and/or an emission control signal 74. For example, the data line voltage signal 66 may be an analog voltage signal indicative of the compensated image data 62 (e.g., compensated pixel data of luminance values), and the scan control signal may be a selection signal to access a specific sub-pixel 64. Additionally, the emission control signal 74 may connect or disconnect a light emissive element 76 (e.g., an organic or micro light emitting diode) of the sub-pixel 64 to the sub-pixel circuitry 78 and/or a power supply rail 79, for example, to disconnect the light emissive element 76 when a new data line voltage signal 66 is being written to the sub-pixel circuitry 78 and to connect the light emissive element 76 for illumination.

Furthermore, the sub-pixel 64 may include one or more switching devices 80 (e.g., p-type metal-oxide-semiconductor (PMOS) transistors, n-type metal-oxide-semiconductor (NMOS) transistors, etc.) and a storage capacitor 82. In the depicted example, the storage capacitor 82 may be coupled between the power supply rail 79 (e.g., VDD) and an internal (e.g., current control) node 84 of the sub-pixel 64. Additionally, the voltage on the node 84 may control a gate 86 of a switching device 80. The light emission from the sub-pixel 64 may vary based on the magnitude of electrical current supplied to its light emissive element 76. Thus, to facilitate controlling light emission, the voltage at the internal node 84 may be regulated such that the switching device 80 controlled by the gate 86 is operated in its linear mode (e.g., region) such that its channel width and, thus, permitted current flow varies proportionally with the voltage of the internal node 84.

Additionally, IR drop may occur due to the internal resistance of the sub-pixel circuitry 78. For example, the internal resistance associated with the data lines and/or power supply rail 79 and/or switching devices 80 may cause a voltage drop at the light emissive element 76 and/or internal node 84 leading to a reduced luminance output. Moreover, at higher current draws (e.g., due to higher target luminance outputs) the IR drop may increase. As such, the target luminance level of the pixel data may be used to estimate a compensation for the IR drop.

Additionally or alternatively, the voltage at the internal node 84 may vary due at least in part to current leakage between the internal node 84 of the sub-pixel 64 and the data line 68 and/or other sub-pixels 64. As an illustrative example, a leakage path 88 may enable electrical current to flow from the storage capacitor 82 to the data line 68, thereby discharging the storage capacitor 82 and, thus, reducing the voltage at the internal node 84 of the sub-pixel 64. Moreover, in some instances, parasitic capacitance 90 may occur between the electrically conductive material in the sub-pixel 64, that of neighboring sub-pixels 64, and/or the data line 68 due to the close proximity, and may factor into the current leakage. As should be appreciated, the parasitic capacitance 90 is not a physical capacitor and is depicted merely for illustrative purposes.

Furthermore, in some instances, the change in voltage over time (dv/dt) of electrical power flowing through the data line 68, to the sub-pixel 64 or a sub-pixel in close proximity, may induce an electrical current in the sub-pixel 64, which may charge and/or discharge the storage capacitor 82 and, thus, change the voltage at the internal node 84. In general, the current leakage associated with a sub-pixel 64 of interest may depend on the data line voltage signal 66 supplied to each of the sub-pixels 64 in proximity to the sub-pixel 64 of interest. As such, a leakage compensation may be determined based on the data line voltage signal 66 (e.g., corresponding to the pixel data luminance levels) to the sub-pixel 64 of interest and the surrounding sub-pixels.

Figure 9:
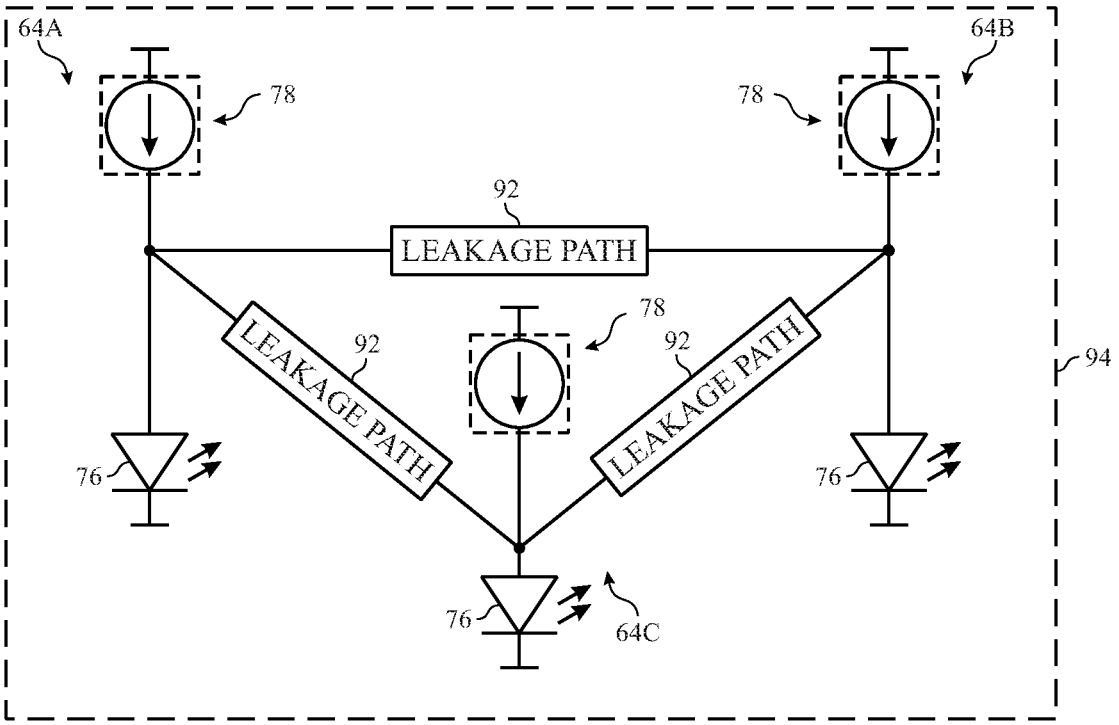
FIG. 9 is a schematic diagram of intra-pixel current leakage paths, in accordance with an embodiment.

As stated above, the current leakage between sub-pixels 64 may be intra-pixel and/or inter-pixel. To help further illustrate the intra-pixel leakage paths 92, FIG. 9 is a schematic diagram of a pixel 94 and three sub-pixels 64A, 64B, and 64C. Each one of the sub-pixels 64A, 64B, and 64C may have an effect on the other two. For example sub-pixel 64A has an effect on sub-pixels 64B and 64C, sub-pixel 64B has an effect on sub-pixels 64A and 64C, and sub-pixel 64C has an effect on sub-pixels 64A and 64B.

Figure 10:
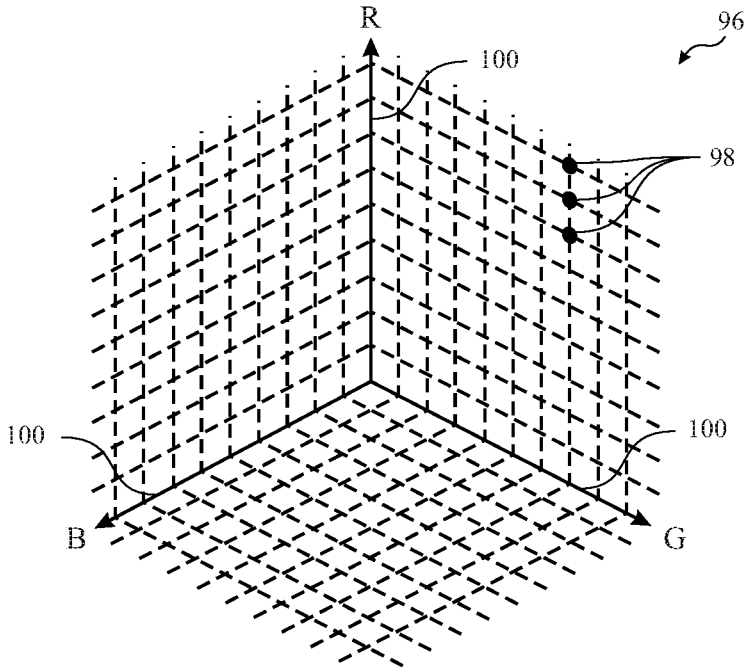
FIG. 10 is a three-dimensional representation of a lookup table (LUT), in accordance with an embodiment.

In one embodiment of the present disclosure, the intra-pixel compensation sub-block 54 may apply a three-dimensional (3D) lookup table (LUT) 96, for example as depicted in FIG. 10, to the input image data 60 to compensate for intra-pixel current leakage. Indeed, because of the interdependencies on each other and/or the fact that the pixel data for the sub-pixels 64A, 64B, and 64C may be already grouped together, it may be efficient (e.g., in processor, memory, and/or data path bandwidth) to use a 3D LUT 96 with the set of sub-pixel luminance values (e.g., RGB) for a particular pixel. The 3D LUT 96 may transform the input set of luminance values of each of the sub-pixel components (e.g., red, green, and blue), and map them to one of the output sets 98. For example, the axes 100 of the 3D LUT 96 may each correspond to a sub-pixel component, the collective values of which identify the coordinates in the 3D LUT 96 for an output set 98. The output set 98 may define values for each of the sub-pixel components of the input image data 60 compensated for the intra-pixel leakage. The compensated image data 62 may take into account the values of each sub-pixel 64A, 64B, and 64C, relative to each of the other sub-pixels, and boost the luminance of sub-pixels that would have otherwise decreased in luminance output and/or attenuate the luminance of sub-pixels that would have otherwise increased in luminance output.

As stated above, the 3D LUT 96 may include an axis 100 for each sub-pixel component. Moreover, in some embodiments, the dimension of the LUT may change based on input image data 60 and/or the capabilities of the electronic display 12. For example, if the electronic display 12 included pixels having two or four color components, the LUT and the output set of the LUT may have a dimension of two or four, respectively.

In a similar manner to the intra-pixel compensation sub-block 54, the IR drop compensation sub-block 58 may utilize a 3D LUT 96 to compensate for IR drop by boosting the luminance of a sub-pixel based on the luminance level of the sub-pixel and/or the luminance of the surrounding sub-pixels. For example, a sub-pixel 64 with a higher target luminance may be given a larger boost to compensate for a larger IR drop because the higher amount of current associated with the higher target luminance may induce a larger IR drop.

As stated above, LUTs may be used for their effectiveness, such as in speed and efficiency. However, algorithms executed in software may also be used to make such calculations. Furthermore, the LUT(s) used by the pixel compensation block 50 may be based on and/or calculated from algorithms for estimating the current leakage. For example, in one embodiment, the intra-pixel and/or inter-pixel current leakage may be modeled by leakage paths of an estimated impedance. As the voltage differential between sub-pixels increases, the leakage current may also increase. Moreover, sub-pixels of different types (e.g., color) may be more susceptible to current leakage, for example, depending on hardware implementation (e.g., the light emissive element 76, the sub-pixel circuitry 78, and/or the layout, location, or orientation thereof).

In some embodiments, the LUTs may be pre-determined during manufacturing and stored in memory (e.g., controller memory 46). Additionally or alternatively, the LUTs may be calculated by the electronic device 10. For example, the electronic device 10 may model the sub-pixels 64 and leakage paths (e.g., intra-pixel and/or inter-pixel) and factor in environmental variables (e.g., temperature, humidity, ambient lighting, etc.), user settings (e.g., a brightness setting), a brightness output of the electronic display 12, burn-in statistics of the sub-pixels 64, hardware specific variables, and/or other factors that may affect current leakage and/or IR drop. Moreover, from the model, the electronic device 10 may generate the LUTs. Furthermore, a single 3D LUT 96 may be generated and applied to the entire electronic display 12, an active region (e.g., a portion of the screen experiencing activity) of the electronic display 12, or the electronic display 12 may be broken up into multiple areas, and a different 3D LUT 96 may be generated for each area.

Additionally, in one embodiment, the compensation for IR drop and current leakage may be combined into a single 3D LUT 96. For example, the 3D LUT 96 compensating for IR drop may be added (e.g., linearly) to the 3D LUT 96 for compensating for intra-pixel current leakage. Moreover, in some embodiments, the compensation from IR drop and the intra-pixel current leakage may be linearly or nonlinearly weighted and summed. The single 3D LUT 96 may then be used to efficiently and effectively compensate for current leakage and/or IR drop.

Figure 11:
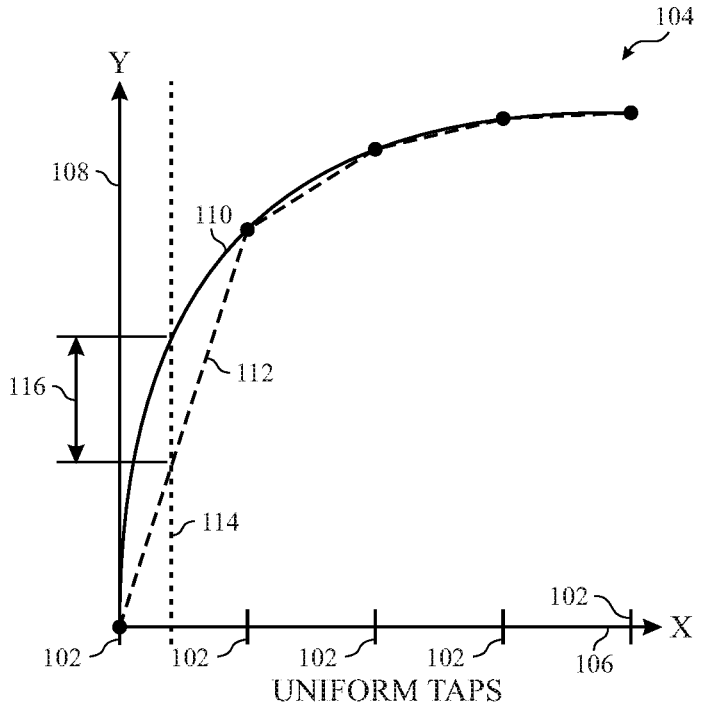
FIG. 11 is a graph of an intra-pixel current leakage compensation function with uniform taps, in accordance with an embodiment.

In some embodiments, the 3D LUT 96 may include axes 100 that span the entire range of luminance levels (e.g., based on the input image data bit depth and/or the bit depth capabilities of the electronic display 12). In some scenarios, it may not be practical to include a tap point in the 3D LUT 96 for each luminance value. As such, the 3D LUT 96 may utilize a reduced number (e.g., less than 100, less than 40, less than 20, etc.) of tap points such that luminance levels between tap points may be interpolated (e.g., linear interpolation, double linear interpolation, or non-linear interpolation) to define compensation values between the tap points of the 3D LUT 96. Additionally, the LUT(s) for IR drop and current leakage may have equally or approximately uniformly spaced tap points 102 to facilitate interpolation, as shown in the graph 104 of FIG. 11, where the x-axis 106 is the luminance level of the sub-pixel 64 of interest and the y axis 108 is the output compensated value as depicted in one dimension of the 3D LUT 96. Furthermore, the compensation function 110 is indicative of a desired compensated value (e.g., as based upon an algorithm) and the interpolated function 112 is indicative of a linear interpolation of the compensation function 110 between two tap points 102.

For a given luminance level 114 between two tap points 102, there may be an associated interpolation error 116. Further, in some embodiments, the interpolation error 116 may be greater at lower brightness levels (e.g., lower luminance levels) due to the concavity (e.g., double derivative) of the compensation function 110 being greater at lower luminance levels. In other words, interpolation of the compensation values of the compensation function 110 may lead to greater errors in interpolation at lower brightness than at higher brightness.

Figure 12:
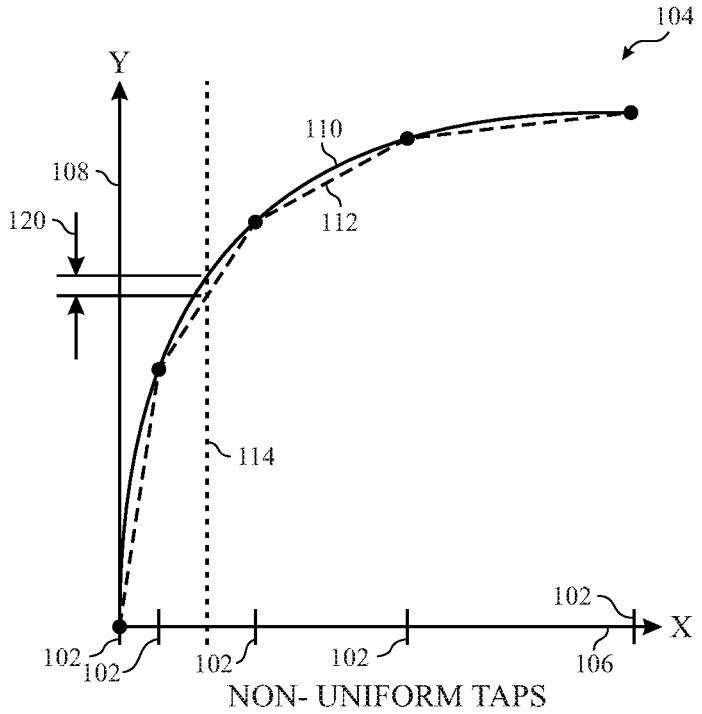
FIG. 12 is a graph of an intra-pixel current leakage compensation function with non-uniform taps, in accordance with an embodiment.

In one embodiment, a second 3D LUT 96 may be made with non-uniform tap points 102, as shown by the graph 118 of FIG. 12. The use of non-uniform tap points 102 may "squeeze" the tap points 102 of the 3D LUT 96 at lower brightness and spread out the tap points 102 of the 3D LUT 96 at higher brightness. Using the non-uniform tap points 102, the second 3D LUT 96 may have a reduced interpolation error 120 at lower brightness, and, in some embodiments, may be subject to an increased interpolation error at high brightness. To maintain fidelity at both ends of the brightness spectrum, the 3D LUT 96 with uniform tap points 102 may be used above a threshold brightness (e.g., 500 nits, 100 nits, 50 nits, 10 nits, etc.), and the 3D LUT 96 with non-uniform tap points 102 may be used below the threshold brightness. As used herein, the brightness may be indicative of an average or total luminance output (e.g., light intensity output) of the electronic display 12, a maximum brightness of the electronic display 12, and/or a brightness setting of the electronic display 12. Moreover, the brightness may be determined or estimated, relative to the threshold brightness, based on the input image data 60 and/or a brightness setting of the electronic display 12.

Additionally or alternatively, in some embodiments, a single 3D LUT 96 may be used (e.g., for the entire electronic display 12 or a portion thereof), and the input image data 60 may be mapped to a non-linear space (e.g., a gamma color space or other non-linear space) before the 3D LUT 96 is applied to effectively "squeeze" the tap points 102 of the 3D LUT 96 at lower brightness and spread out the tap points 102 of the 3D LUT 96 at higher brightness. Moreover, when the brightness of the display is less than the threshold value, the non-linear mapping may be engaged, the 3D LUT 96 applied, and an inverse mapping may be utilized to return the image data to the original color space. Further, because of the lack of variation in tap point 102 spacing in the original color space and the effectively increased spacing of tap points 102 in the non-linear color space, when the brightness of the display is greater than the threshold value, the non-linear mapping and inverse mapping transformations may be disengaged/bypassed. As such, the same 3D LUT 96 may be utilized in different color spaces depending on the brightness of the electronic display 12 relative to a threshold to obtain better interpolation resolution between tap points 102 in both low brightness and high brightness. As should be appreciated, if the original color space is a non-linear space, a linear mapping may be made to transform the non-linear space into a linear space, used for brightness above the threshold, and inverse mapped back into the non-linear space. In either case, the 3D LUT 96 may be reused for both high and low brightness, but with the higher fidelity for interpolation at the lower brightness settings.

Figure 13:
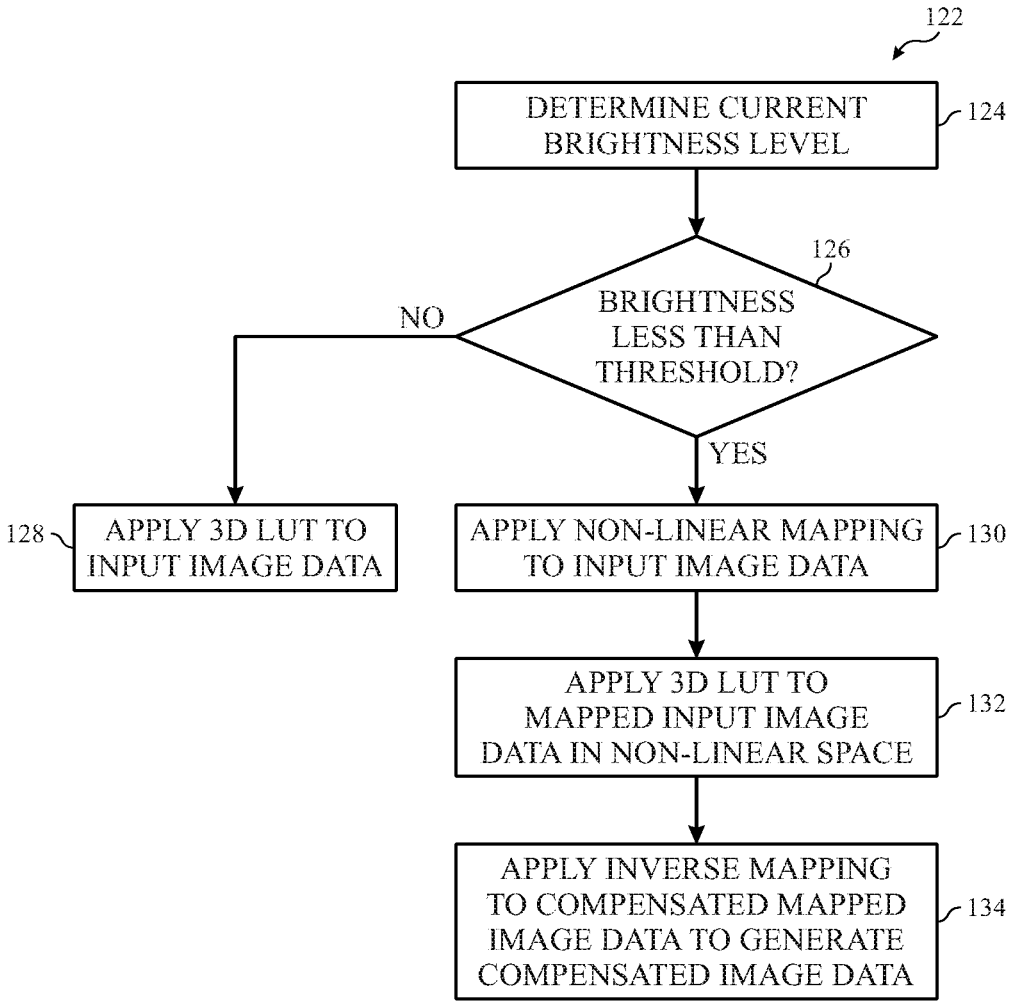
FIG. 13 is a flow chart of an example process for determining compensated image data, in accordance with an embodiment.

To help illustrate, FIG. 13 is a flow chart 122 for reusing a 3D LUT 96 in different scenarios depending on the brightness. The current brightness level may be determined (process block 124). For example, the brightness level may be determined based on a sensed brightness (e.g., via an electronic sensor), an average luminance level (e.g., calculated locally or globally), a maximum luminance level, a brightness of the electronic display 12, or any other suitable measure of brightness. It may then be determined if the brightness is less than a threshold value (decision block 126). If the brightness is not less than the threshold, then the 3D LUT 96 may be applied to the input image data 60 (process block 128). On the other hand, if the determined brightness is less than the threshold, a non-linear mapping may be applied to the input image data 60 (process block 130), for example, to transform the input image data 60 to a non-linear space and provide reduced interpolation errors 120 at low brightness. The 3D LUT 96 may then be applied to the mapped input image data 60 in the non-linear space (process block 132). An inverse mapping may then be applied to the compensated mapped image data to return to the image data to the linear space and generate the compensated image data 62 (process block 134).

Figure 14:
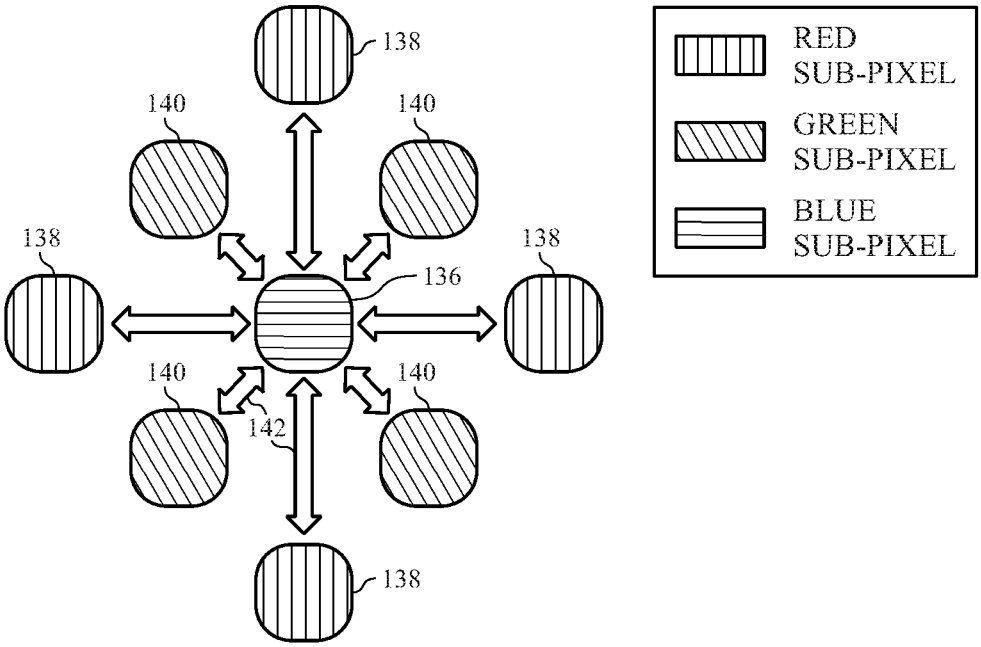
FIG. 14 is a schematic diagram of inter-pixel current leakage, in accordance with an embodiment.
Figure 15:
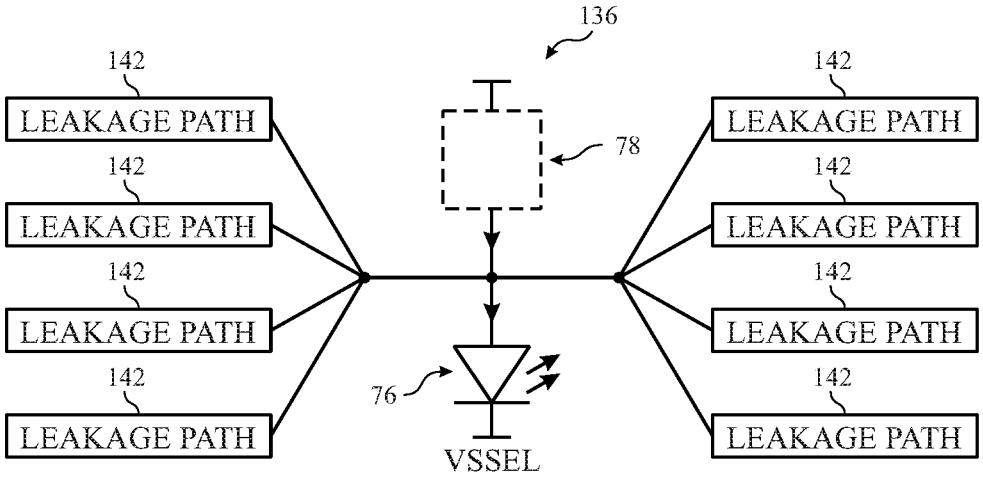
FIG. 15 is a schematic diagram of the inter-pixel current leakage of claim 14, in accordance with an embodiment.

As discussed above, intra-pixel current leakage compensation may assist in reducing perceivable artifacts. Additionally, in some embodiments inter-pixel current leakage may also occur and/or be compensated, for example, via the inter-pixel compensation sub-block 56. For example, FIG. 14 depicts a blue sub-pixel 136 surrounded by four red sub-pixels 138, and four green sub-pixels 140. As should be appreciated, the sub-pixel pattern is given as a non-limiting example. As with the intra-pixel leakage paths 92, each sub-pixel 138 and 140 surrounding the sub-pixel of interest 136 has a leakage path 142 to and from the sub-pixel of interest 136. As such, the eight surrounding sub-pixels 138 and 140 define eight leakage paths 142, as illustrated in FIG. 15.

Figure 16:
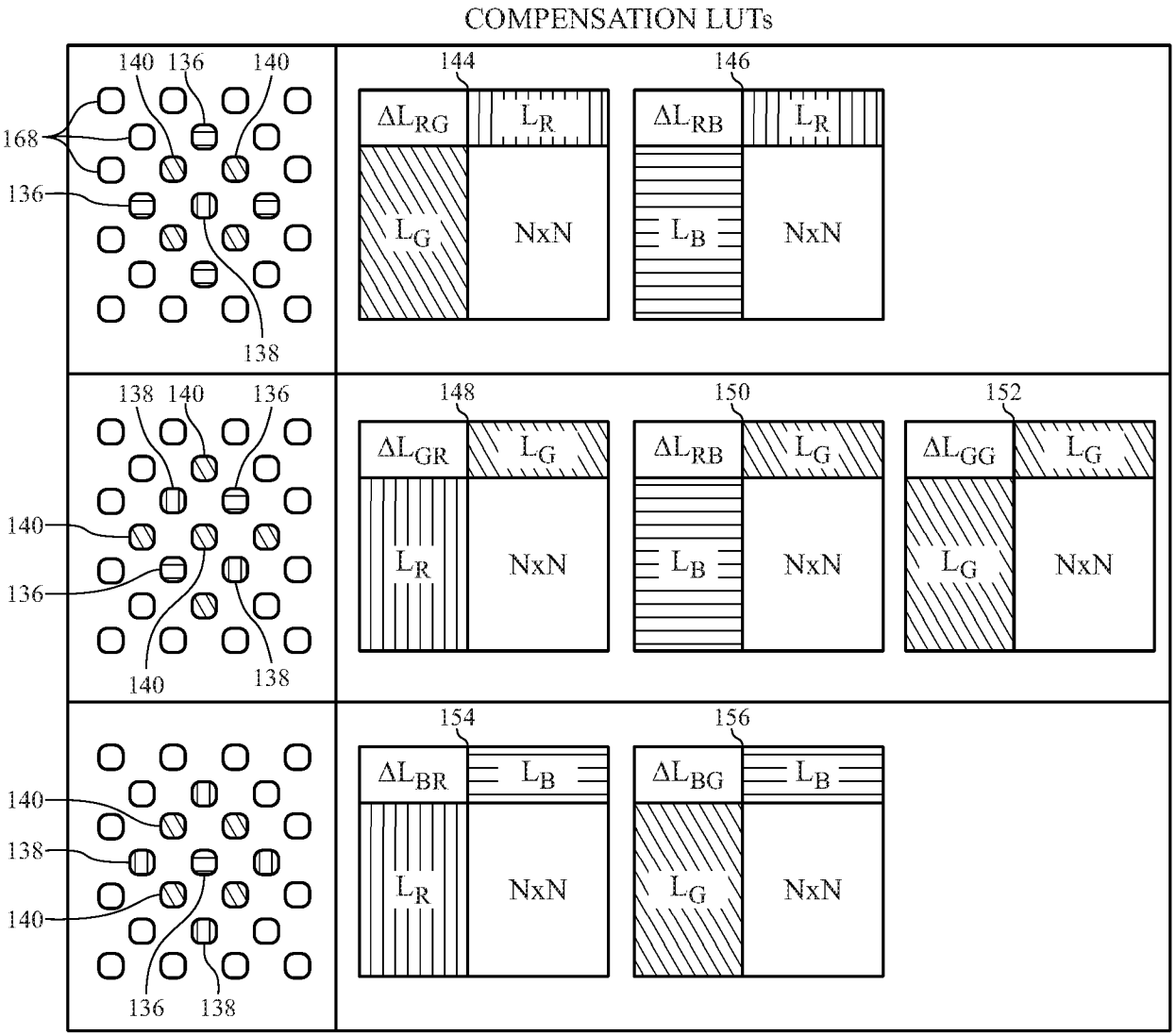
FIG. 16 is a chart of intra-pixel current leakage LUTs, in accordance with an embodiment.
Figure 17:
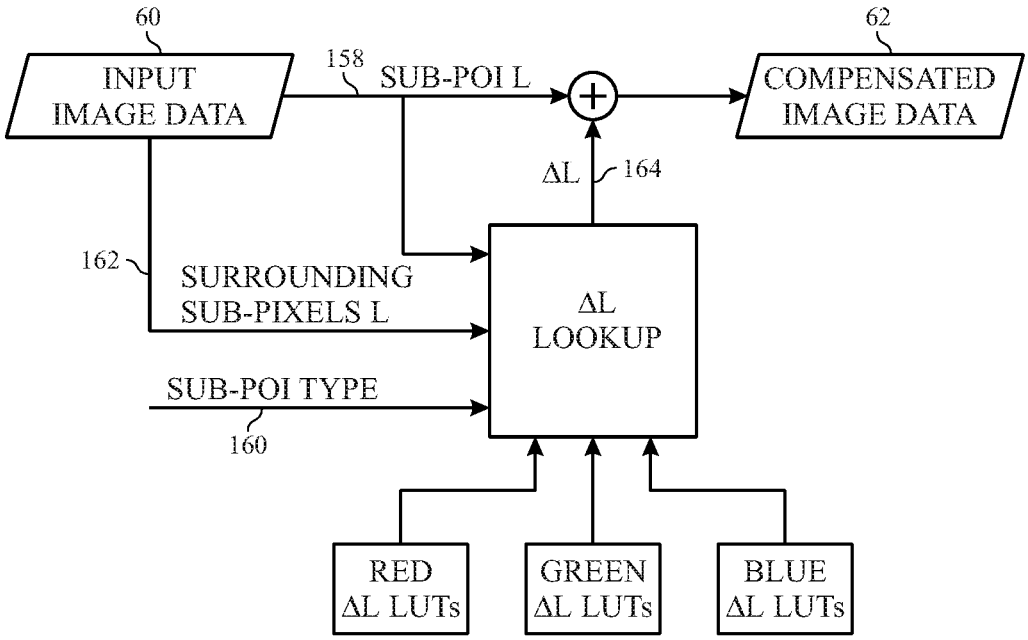
FIG. 17 is a schematic diagram of a process for compensating for inter-pixel current leakage, in accordance with an embodiment.

In one embodiment, the eight current leakage paths 142 may be modeled as three 8-dimensional (8D) LUTs, one for each of the color components, and a dimension for each current leakage path 142. The three 8D LUTs may provide accuracy, but may also be resource intensive (e.g., in memory and/or processing resources). As such, in some embodiments, to reduce complexity, the LUTs may be simplified to seven 2D LUTs as shown in FIG. 16. For example, there may be a LUT for each of corresponding types of current leakage path 142. There may be a LUT 144 for the change in a red sub-pixel 138 due to a green sub-pixel 140, a LUT 146 for the change in a red sub-pixel 138 due to a blue sub-pixel 136, a LUT 148 for the change in a green sub-pixel 140 due to a red sub-pixel 138, a LUT 150 for the change in a green sub-pixel 140 due to a blue sub-pixel 136, a LUT 152 for the change in a green sub-pixel 140 due to a green sub-pixel 140, a LUT 154 for the change in a blue sub-pixel 136 due to a red sub-pixel 138, and a LUT 156 for the change in a blue sub-pixel 136 due to a green sub-pixel 140. Furthermore, for each of the eight current leakage paths 142, the luminance value 158 of the sub-pixel of interest (sub-POI), the type 160 (e.g., color component) of the sub-POI, and the corresponding values 162 for the surrounding sub-pixels may be used to determine an amount of luminance correction 164 to be added to the luminance value 158 of the sub-POI, as illustrated by the schematic diagram 166 of FIG. 17. For example, for a red sub-pixel 138, the luminance value 158 may be input into LUT 144 for the change in a red sub-pixel 138 due to a green sub-pixel 140 for each of the four green sub-pixels 140 surrounding the red sub-pixel 138 and the luminance value 158 may be input into LUT 146 for the change in a red sub-pixel 138 due to a blue sub-pixel 136 for each of the four blue sub-pixels 136 surrounding the red sub-pixel 138.

Returning to FIG. 16, additional sub-pixels 168 also surround the sub-POI further out from the immediately surrounding eight sub-pixels. In some embodiments, additional LUTs may be generated for the additional sub-pixels 168. Because the additional sub-pixels 168 are further away from the sub-POI their effect on sub-POI may be less than the immediately surrounding sub-pixels and, if calculated, may provide a second order approximation to the luminance correction 164 for compensation. In some embodiments, the additional sub-pixels 168 are ignored for simplicity. Moreover, as stated above with regard to the 3D LUTs, the 8D and/or 2D LUTs may be pre-programmed and/or determined by the electronic device 10.

Figure 18:
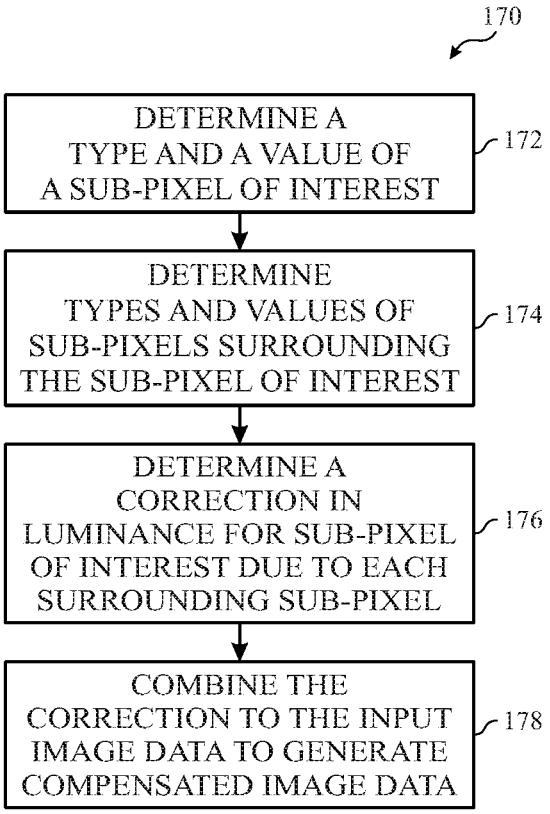
FIG. 18 is a flow chart of an example process for compensating for inter-pixel current leakage, in accordance with an embodiment.

FIG. 18 is a flowchart 170 for inter-pixel current leakage compensation. The type 160 (e.g., color component) and luminance value 158 of the sub-POI may be determined (process block 172). Additionally, the types and corresponding values 162 of the surrounding sub-pixels are determined (process block 174), and the plugged into the corresponding compensation LUTs 144, 146, 148, 150, 152, 154, and/or 156. The luminance correction 164 may then be determined (process block 176), and the luminance corrections 164 may be combined to the luminance value 158 of the input image data 60 to generate the compensated image data 62 (process block 178). For example, referring back to FIGS. 14 and 15, the blue sub-pixel 136 may have four luminance corrections 164 due to the red sub-pixels 138 and four luminance corrections 164 due to the green sub-pixels 140. In some embodiments, the combination of the luminance corrections 164 may include a sum, a weighted sum, multiplication, an average, and/or weighted average based on position, type, luminance value 158, and/or brightness setting of the electronic display 12.

Further, although discussed herein as being separate sub-blocks, the intra-pixel compensation sub-block 54, the inter-pixel compensation sub-block 56, and the IR drop compensation sub-block 58 may be merged, moved to one of the other processing blocks 52, removed, bypassed, and/or repeated. Furthermore, the input image data 60 for one of either the intra-pixel compensation sub-block 54, the inter-pixel compensation sub-block 56, or the IR drop compensation sub-block 58 may be the compensated image data 62 of another. Moreover, in some embodiments, any of the inter-pixel compensation sub-block 56, and the IR drop compensation sub-block 58 may be implemented without one or either of the remaining two or implemented all together simultaneously to compensate for the lateral leakage of current between sub-pixels and/or IR drop and reduce perceivable artifacts such as banding, color inaccuracies, edge effects, etc.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

an electronic display comprising a plurality of pixels and configured to display an image based at least in part on processed image data, wherein each of the plurality of pixels comprises a plurality of sub-pixels; and image processing circuitry configured to:

receive input image data in a first color space, wherein the input image data comprises luminance values for each of the plurality of sub-pixels;

map the input image data from the first color space to a second color space;

apply a multi-dimensional lookup table based on the input image data in the second color space to generate compensated image data, wherein the multi-dimensional lookup table is configured to:

receive the luminance values for each of the plurality of sub-pixels; and output corrected luminance values for each of the plurality of sub-pixels, wherein the corrected luminance values are compensated for an expected amount of current leakage between the plurality of sub-pixels; and inversely map the compensated image data from the second color space to the first color space to generate the processed image data.

2. The electronic device of claim 1, wherein the image processing circuitry is configured to:

determine whether a brightness of the electronic display is less than a threshold brightness; and map the input image data from the first color space to the second color space in response to determining that the brightness of the electronic display is less than the threshold brightness.

3. The electronic device of claim 2, wherein in response to determining that the brightness is not less than the threshold brightness, the image processing circuitry is configured to:

bypass mapping the input image data from the first color space to the second color space;

apply the multi-dimensional lookup table to the input image data in the first color space to generate the processed image data; and bypass inverse mapping of the input image data.

4. The electronic device of claim 2, wherein the brightness comprises a brightness setting of the electronic display.

5. The electronic device of claim 2, wherein the brightness comprises a light intensity output of the electronic display.

6. The electronic device of claim 1, wherein the image processing circuitry is configured to model the expected amount of current leakage and generate the multi-dimensional lookup table based at least in part on the model.

7. The electronic device of claim 1, wherein the image processing circuitry is configured to generate the multi-dimensional lookup table based at least in part on a temperature of the plurality of sub-pixels.

8. The electronic device of claim 1, wherein the first color space comprises a linear color space and the second color space comprises a non-linear color space.

9. The electronic device of claim 1, wherein the multi-dimensional lookup table comprises uniform tap points of corrected luminance values.

10. The electronic device of claim 9, wherein the image processing circuitry is configured to interpolate between the uniform tap points of corrected luminance values to generate the compensated image data.

11. The electronic device of claim 1, wherein the corrected luminance values are compensated for an expected amount of voltage drop associated with an internal resistance (IR) of each of the plurality of sub-pixels.

12. A method comprising:

receiving, via image processing circuitry, input image data in a first color space, wherein the input image data comprises luminance values for each of a plurality of sub-pixels of an electronic display;

determining that a brightness of the electronic display is less than a threshold brightness;

in response to determining that the brightness of the electronic display is less than the threshold brightness, mapping the input image data from the first color space to a second color space;

applying a multi-dimensional lookup table based on the input image data in the second color space to generate compensated image data, wherein the multi-dimensional lookup table is configured to map the luminance values for each of the plurality of sub-pixels to corrected luminance values for each of the plurality of sub-pixels, wherein the corrected luminance values are compensated for an expected amount of voltage drop associated with an internal resistance of each of the plurality of sub-pixels; and mapping the compensated image data from the second color space to the first color space to generate processed image data.

13. The method of claim 12, wherein the corrected luminance values are compensated for an expected amount of leakage current between sub-pixels of the plurality of sub-pixels.

14. The method of claim 12, wherein the multi-dimensional lookup table comprises a dimension for each type of sub-pixel of a pixel.

15. The method of claim 14, wherein each type of sub-pixel comprises a different color component associated with the type.

16. The method of claim 12, wherein determining that the brightness of the electronic display is less than the threshold brightness comprises determining that a brightness setting of the electronic display is less than a threshold brightness setting.

17. The method of claim 16, wherein the brightness setting is user selectable.

18. A non-transitory machine readable medium comprising instructions, wherein, when executed by a processor, the instructions cause the processor to:

receive input image data in a linear color space, wherein the input image data comprises luminance values for sub-pixels of each of a plurality of pixels of an electronic display, wherein each pixel of the plurality of pixels comprises three sub-pixels;

determine that a brightness of the electronic display is less than a threshold brightness;

in response to determining that the brightness of the electronic display is less than the threshold brightness, map the input image data from the linear color space to a non-linear color space;

apply a three-dimensional (3D) lookup table based on the input image data in the non-linear color space to generate compensated image data, wherein the 3D lookup table is configured to transform the luminance values for the three sub-pixels of each pixel to corrected luminance values, wherein the corrected luminance values are compensated for an expected amount of voltage drop associated with an internal resistance of each sub-pixel and a current leakage between sub-pixels of each pixel; and map the compensated image data from the non-linear color space to the linear color space to generate processed image data for display on the electronic display.

19. The non-transitory medium of claim 18, wherein, when executed by the processor, the instructions cause the processor to generate the 3D lookup table based at least in part on a temperature of the sub-pixels.

20. The non-transitory medium of claim 18, wherein the brightness comprises a light intensity output of the electronic display.

21. The non-transitory medium of claim 18, wherein each axis of the 3D lookup table corresponds to luminance value of a sub-pixel of the three sub-pixels.

* * * * *